United States Patent [19]

Jones

[11] Patent Number: 4,984,691

[45] Date of Patent: Jan. 15, 1991

[54] CONTAINER

[75] Inventor: David L. Jones, Ruskington, England

[73] Assignee: Styropack (UK) Limited, Aberdeen, Scotland

[21] Appl. No.: 429,712

[22] Filed: Oct. 31, 1989

[51] Int. Cl.[5] ..... B65D 21/06; B65D 43/16

[52] U.S. Cl. ..... 206/506; 220/339

[58] Field of Search ..... 206/506; 220/339

[56] References Cited

U.S. PATENT DOCUMENTS

| | | | |
|---|---|---|---|
| 2,765,099 | 10/1956 | Lively | 206/506 |
| 3,100,056 | 8/1963 | Friday | 230/339 |
| 3,651,977 | 3/1972 | Morgan | 206/506 |
| 4,765,480 | 8/1988 | Malmanger | 206/506 |

FOREIGN PATENT DOCUMENTS

| | | | |
|---|---|---|---|
| 7905105 | 12/1980 | Netherlands | 206/506 |
| 210081 | 5/1966 | Sweden | 206/506 |
| 1245100 | 9/1971 | United Kingdom | 206/506 |

*Primary Examiner*—George E. Lowrance

*Attorney, Agent, or Firm*—Poms, Smith, Lande & Rose

[57] ABSTRACT

A container (10) comprises a body having a base (12), two pairs of opposed side walls (14,16) extending upwardly from the base (12) to define a corner (15a,15b,15c,15d) between adjacent side walls (14,16). Four support members, (32a,32b,32c,32d) are provided, each support member being disposed at a respective corner. The support members are selectively movable between a first position in which a further container can be nested inside the body, and a second position in which the support members can support the further container above the base. A first pair of said support members (32a,32b) is connected together by a first connecting member (34) provided therebetween, and a second pair of said support members (32c,32d) is connected together by a second connecting member (36) provided therebetween.

13 Claims, 5 Drawing Sheets

CONTAINER

BACKGROUND OF THE INVENTION

This invention relates to a container.

In GB-A-2129401 there is disclosed a stacking/nesting container which has a flap hingedly attached to each of two opposed side walls. The flaps are pivotable between one position in which they allow a further container to nest inside the first container, and another position in which they can support the further container upon the first container.

A similar type of container is disclosed in GB-A-2149759, U.S. Pat. No. 3,169,659 and FR-A-2296571.

Another type of container is disclosed in GB-A-2177377. According to this specification a hinged flap is mounted at each corner of the container. In total there are four flaps each of which is pivotable between one position in which they allow a further container to be nested inside the first container, and a second position in which they ca support the further container upon the first container.

SUMMARY OF THE INVENTION

According to the present invention there is provided a container comprising a body having a base, two pairs of opposed side walls extending upwardly from the base to define a corner between adjacent side walls, four support members, each support member being disposed at a respective corner, the support members being selectively movable between a first position in which a further container can be nested inside the body, and a second position in which the support members can support the further container above the base, characterised in that a first pair of said support members is connected together by a first connecting member provided therebetween, and a second pair of said support members is connected together by a second connecting member provided therebetween.

Advantageously, each connecting member is generally elongate with a longitudinal axis which is substantially parallel to an axis passing through the two support members to which it is connected.

Preferably the lateral dimension of each connecting member is less than the corresponding lateral dimension of each support member. This lateral dimension can be measured in a direction towards the opposing connecting member.

Desirably each connecting member is provided with a support surface which can support the further container when the support members are in the second position.

Each connecting member is preferably provided with a plurality of recesses along its length, and two opposed side walls of the body are preferably provided with a plurality of co-operating anti-torsion formations; the formations are received in said recesses when said support members are in the second position. Similar recesses and co-operating formations can also be provided in the support members and the side wall in the region of the support members.

The anti-torsion formations and corresponding recesses are preferably substantially elongate and may extend substantially parallel to the longitudinal axis of the connecting members.

A strengthening formation can be provided which extends, preferably substantially continuously, over each support member and along the respective connecting member to which each support member is connected, each strengthening formation engaging the inner surface of said side walls when the support members are in the second position. The ends of this formation may be received in a recess provided in the side wall. This arrangement transfers the weight of the other containers onto a particular area of the side wall, which area can be be especially strengthened.

In a preferred construction the support members and the sidewalls are provided with complementary detent means for securing the support members in the second position; the complementary detent means may comprise at least one resilient tongue on each support member adapted to extend through a respective aperture on the side wall and engage a respective resilient tongue on the side wall.

When the support member is in the second position the or each resilient tongue on the support members preferably lies between the resilient tongue on the side walls and the space within the container body.

The resilience of the or each tongue on the support members may be such that they can be snapped out of engagement with the respective tongue on the sidewalls with the application of a predetermined amount of force. This feature is useful in case the support members inadvertently are placed in the second position, or if it is desired to re-use the container.

Preferably a lower portion of the or each tongue on the support member curves in a direction towards the respective tongue on the sidewalls to facilitate the snap-release.

The support surface of the support members and the connecting members is preferably provided with a locating formation for locating the further container on the top thereof. The locating formation may also serve to retain the further container in position, and to strengthen the container.

It is preferable that the locating formation extends substantially continuously between the support members.

The provision of the connecting members confers a number of advantages over the prior art. The connecting members enable a more rigid, stronger container to be provided. The connecting members also enable the two connected support members to be moved from the first to the second positions (and vice versa) simultaneously. Also the connecting members can provide a surface which assists with supporting and retaining the further container.

The container may be a plastics material such as polypropylene, and can be formed by injection moulding.

BRIEF DESCRIPTION OF THE DRAWINGS

Reference is now made to the accompanying drawings in which.

DESCRIPTION OF THE PREFERRED EMBODIMENTS

Figure 1:
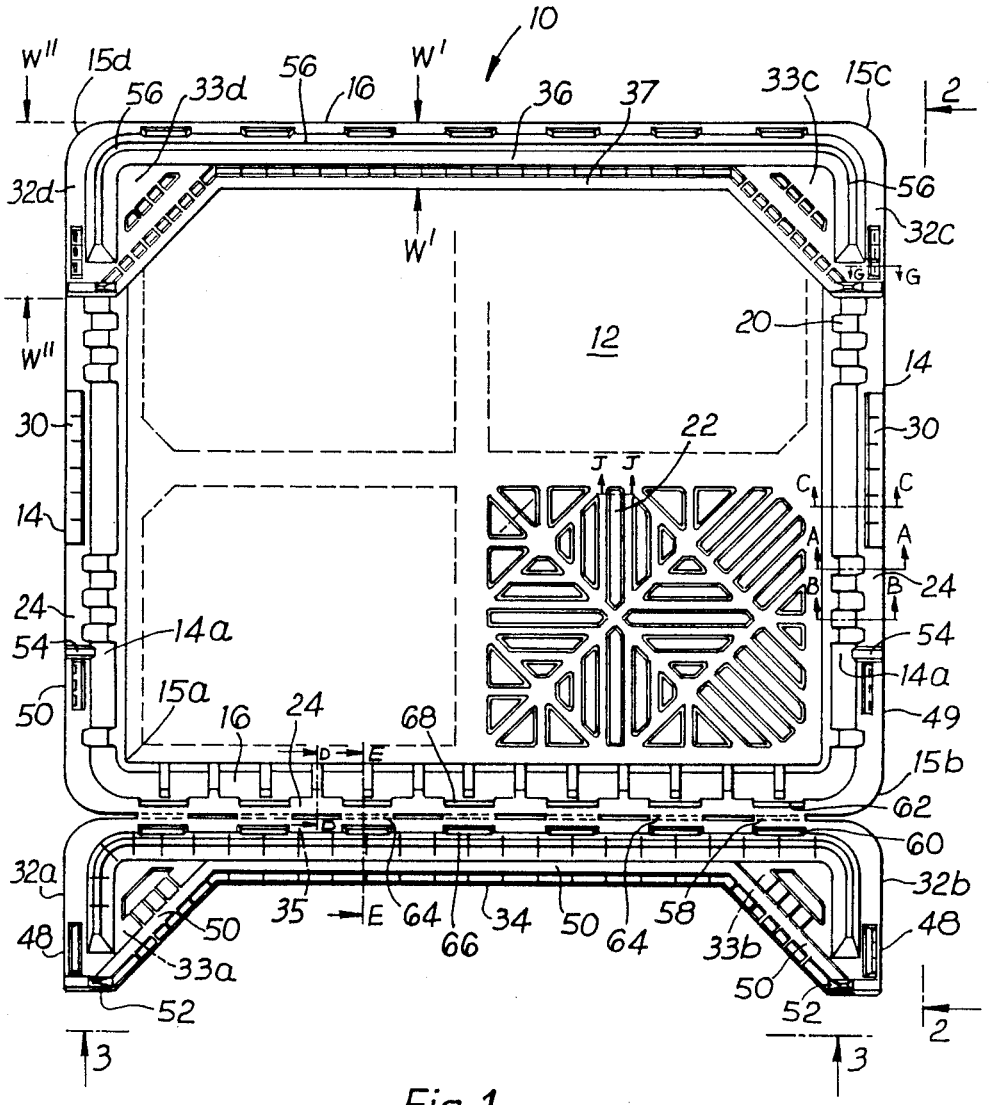
FIG. 1 is a plan view of a container according to the invention.

In the drawings a container generally designated 10 comprises a body having a base 12 and two pairs of opposed side walls 14 and 16 which extend upwardly from the base 12. The base 12 and the side walls 14 and 16 define a substantially hexahedral volume which can receive produce such as fruit and vegetables including mushrooms. Adjacent side walls 14 and 16 are joined at corners 15*a*, 15*b*, 15*c* and 15*d*.

The side walls 14 and 16 are provided with a plurality of apertures 18 and strengthening formations in the form of ribs 20. The base 12 is also provided with strengthening formations in the form of ribs 22; the ribs 22 are arranged to be in line with the plastics flow during the formation of the container 10.

The side walls 14 and 16 are all provided with a lip comprising an outwardly extending portion 24 and a downwardly extending portion 26. A plurality of ribs 28 are provided under the outwardly extending portion 24.

A hand grip formation 30 is provided at opposing sides of the container 10 on the side walls 14. The hand grip formation 30 extends outwardly from the bottom of the downwardly extending portion 26 to provide a surface 31 which can be gripped underneath the rim in order to lift the container 10.

Figure 3:
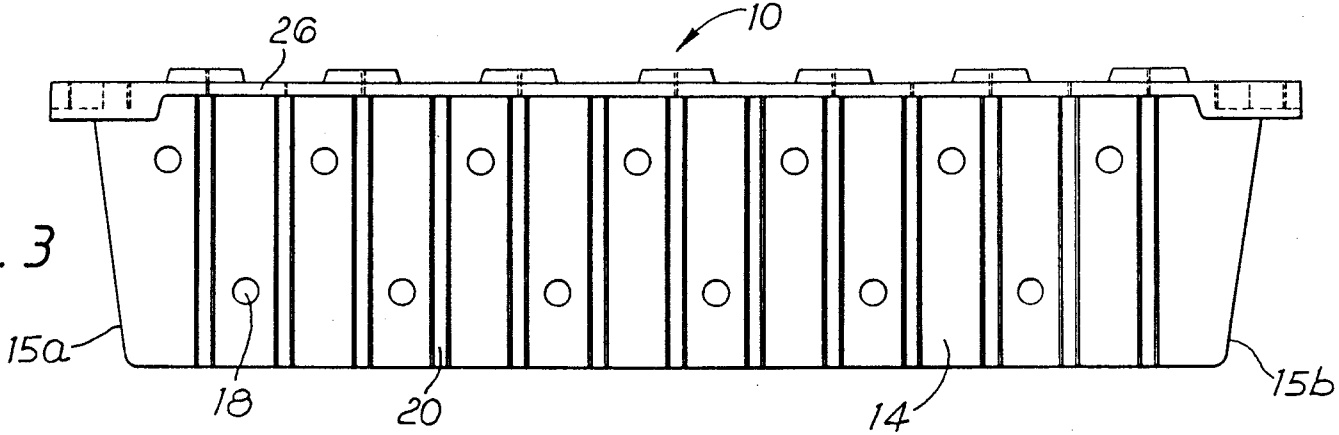
FIG. 3 is a side elevation of a container according to the invention looking along arrows 3—3 in FIG. 1.
Figure 4:
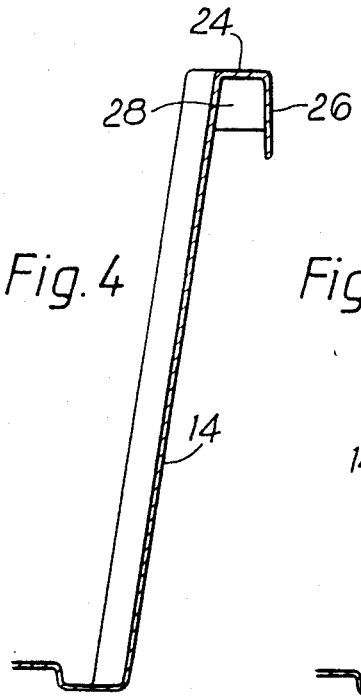
FIGS. 4 to 9 are cross-sectional views taken respectively along lines A—A, B—B, C—C, D—D, E—E and G—G of FIG. 1.
Figure 5:
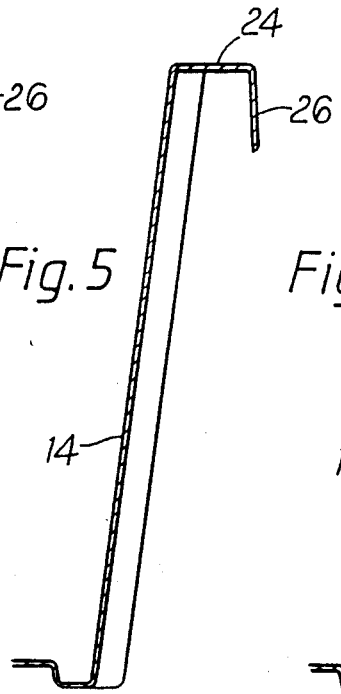
Figure 6:
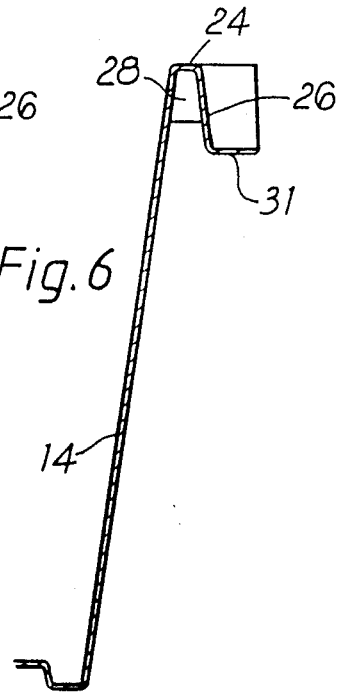
Figure 7:
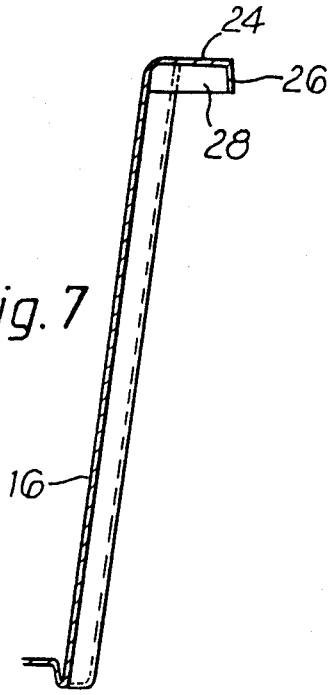
Figure 8:
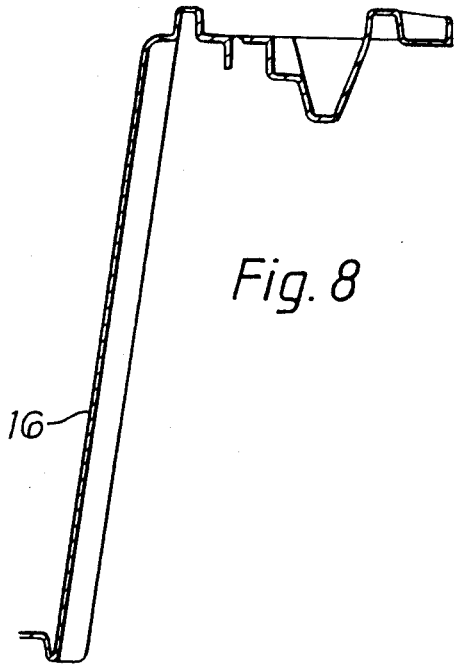
Figure 9:
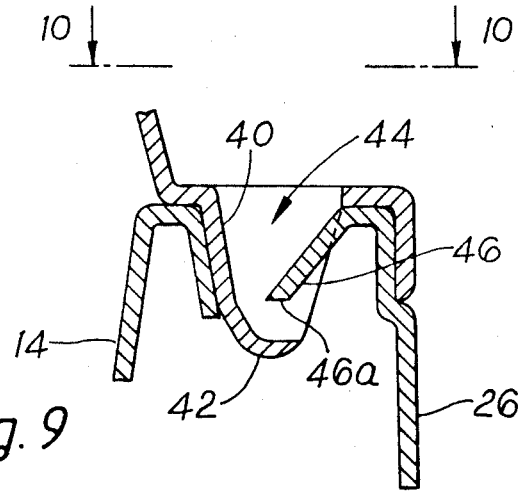
Figure 10:
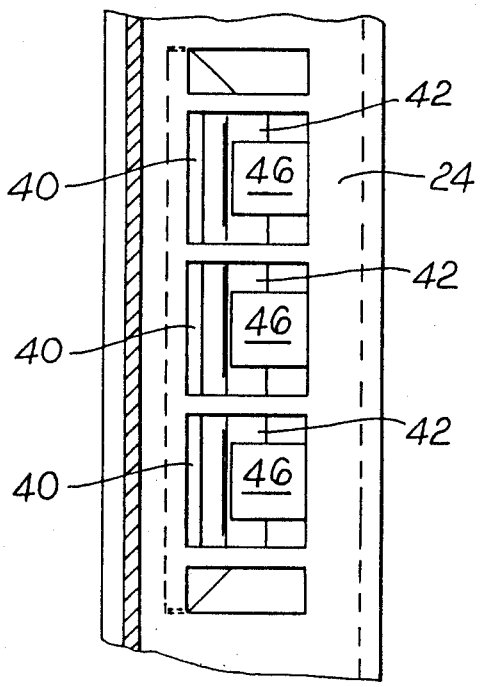
FIG. 10 is a plan view looking in the direction of arrows 10—10 in FIG. 9.

A support member 32*a*, 32*b*, 32*c*, and 32*d* is provided on a respective one of the corners 15*a*, 15*b*, 15*c*, and 15*d* of the container 10; in FIG. 3 the support members 32*a*, 32*b*, 32*c* and 32*d* have been omitted for clarity.

The support members 32*a* and 32*b* are connected by an integral connecting member 34, whilst the support members 32*c* and 32*d* are connected by an integral connecting member 36.

The support members 32a, 32*b*, 32*c* and 32*d* and the connecting members 34 and 36 are pivotally movable between a first position in which a further container (not shown) can be received within the container 10, and a second position in which the further container can be supported above the base 12 by the members 32*a*, 32*b*, 32*c*, 32*d*, 34 and 36. To this end the support members 32*a*, 32*b*, 32*c* and 32d are provided with respective support surfaces 33*a*, 33*b*, 33*c* and 33*d* upon which the further container can be supported; also, the connecting members 34 and 36 are provided with respective support surfaces 35 and 37 upon which the further container can be supported.

The width of the connecting member 36 measured in the direction substantially normal to the plane of the side wall 16 is designated W' in FIG. 1. The width of the support members 32*c* and 32*d* in the same direction is designated W"; it will be observed that W' is less than W"; it is preferred that W' is about one third of W". Similar properties apply to the support members 32*a* and 32*b*, and the connecting member 34.

It will be seen from the drawings that the connecting members 34 and 36 are of elongate configuration, whilst the support members 32*a*, 32*b*, 32*c* and 32*d* are substantially triangular.

In FIG. 1 the connecting member 34 is shown in the first position, whilst the connecting member 36 is shown in the second position.

Figure 11:
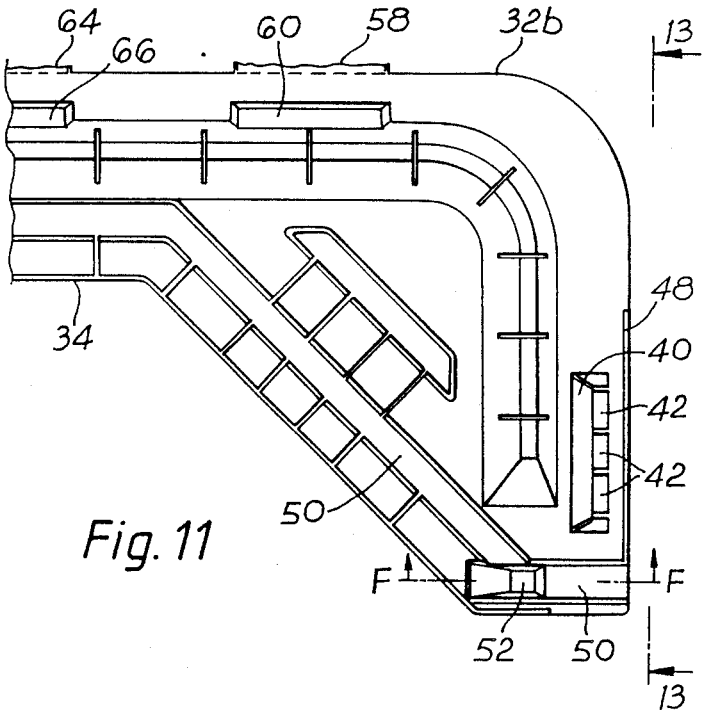
FIG. 11 is a plan view of a support member of the container according to the invention, on an enlarged scale.
Figure 13:
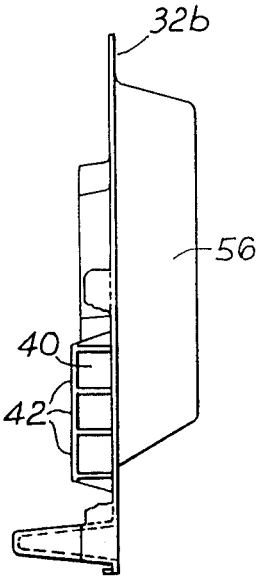
FIG. 13 is a view taken looking in the direction of arrows 13—13 in FIG. 11.
Figure 12:
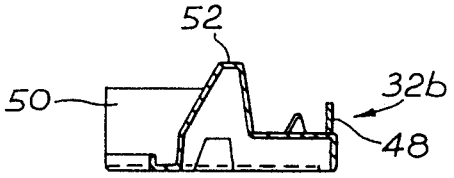
FIG. 12 is a view taken along lines F—F of FIG. 11.

The construction of the support member 32*b* is shown in greater detail in FIGS. 9 to 13; it will be appreciated that the support members 32*a*, 32*c* and 32*d* are of similar construction. FIG. 11 shows a surface of the support member 32*b* opposite to the support surface 33*b*.

The support member 32*b* includes an inner detenting formation in the form of a downwardly extending projection 40 having three tongues 42 extending therefrom. The side walls 14 are provided with an aperture 44 in the outwardly extending portion 24 and three downwardly extending cooperating detents in the form of tongues 46. The tongues 42 are a snap-fit with the tongues 46. When the support member 32*b* is pivotted towards the second position the tongues 42 engage a respective one of the tongues 46 in the aperture 44. The tongues 42 slide over the tongues 46 and deform them. When the tongues 42 reach a point below a bottom surface 46*a* of the tongues 46, the tongues 42 snap under the tongues 46. To assist with this the projections 46 and the projection 40 and tongues 42 can be resiliently deformable. In this is way the support member 32*b* is secured to the side wall 14 in the second position.

Due to the resiliency of the tongues 42, when an upward force is applied to the support member 32*b* the tongues 42 can disengage from the tongues 46 thereby permitting the support member to be moved to the first position. To facilitate this, the lower end of the tongues 42 is curved in a direction towards the tongues 46.

The support member 32*b* is also provided with an outer detenting formation in the form of a projection 48 (not shown in FIG. 13) which can co-operate with a corresponding formation in the form of a recess 49 in the side wall 14. When the support member 32*b* is in the second position, the side wall 14 is effectively clamped between the inner and outer detenting formations to provide a secure locking.

The support member 32*b* is also provided with a strengthening formation 50 which includes a projection 52. The formation 50 is shaped to be able to sit in a cooperating formation in the form of a recess 54 in the rim of the side wall 14. When the support member 32*b* is in the second position, part of the strengthening formation 50 sits in the recess 54, and the projection 52 bears against an inner surface 14*a* of the side wall 14. This arrangement serves to transfer the load of the further container onto the side wall 14 and helps to reduce damage to the support members 32*a*, 32*b*, 32*c* and 32*d* through stress.

Figure 2:
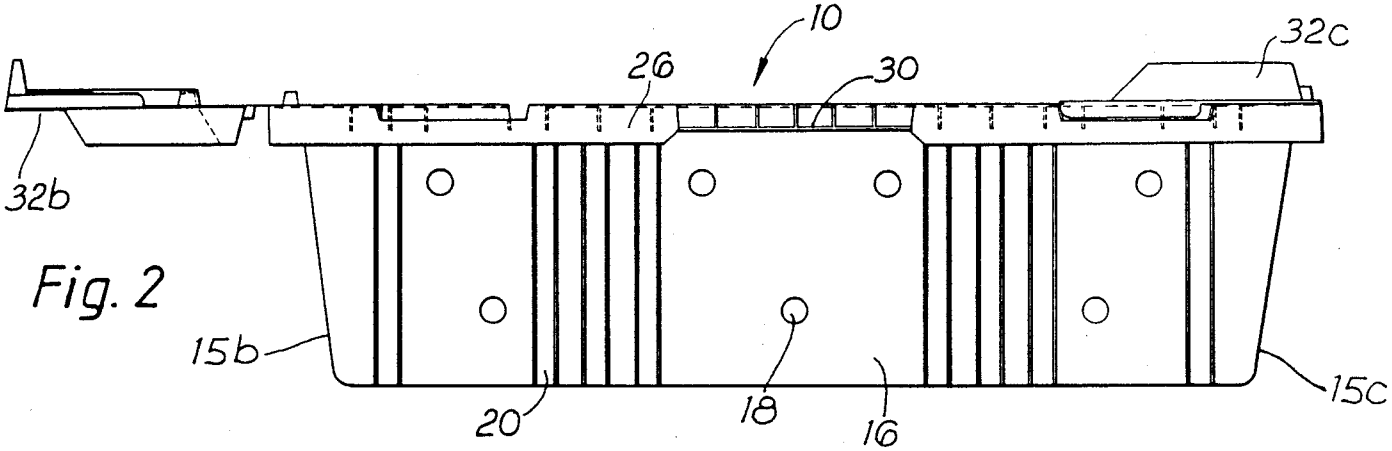
FIG. 2 is a side elevation of a container according to the invention looking along arrows 2—2 in FIG. 1.

Since the strengthening formation 50 extends continuously along the connecting members 34 and 36, a significant part of the weight on the side walls is also transferred to the side wall 14 in the region of the recess 54, This is advantageous because the number of strengthening formations in the region of the recesses 54 can be made especially large to cope with higher load (see FIG. 2).

The strengthening formation 50 is located such that when the connecting member 34 is in the second position, the strengthening formation bears against the inner surface of the side wall 16.

The support surface 33*b* of the support member 32*b* is bounded by a locating formation 56 (not shown in FIG. 12) which is configured such that the further container can be supported by the support surface 33*b* and can bear against the locating formation 56. The locating formation 56 helps to align the further container in the correct position. The locating formation 56 also helps to maintain the further container in the correct position on top of the container 10. In addition the locating formation 56 provides extra strengthening.

The support member **32*b* is pivotally connected to the side wall 16 by a hinge 58. The hinge 58 enables the support member 32*b*** to pivot between the first and second positions.

To assist further with alignment and securing, the support member **32*b* is provided with a recess 60 in the region of the hinge 58 which can receive an anti-torsional formation 62 on the side wall 16**. This arrangement provides resistance to torsional forces.

The connecting members 34 and 36 are substantially identical, so only the member 34 will be described in detail.

The connecting member 34 is integral with the support members **32*a* and 32*b* and is integrally connected to the side wall 16 by a plurality of hinges 64. The hinges 64 enable the connecting member 34, together with the support members 32*a* and 32*b*** to be pivotted between the first and second portions.

To assist with alignment and securing, the support member 34 is provided with a plurality of recesses 66, in the region of the hinges 64, which can receive a respective one of a plurality of anti-torsion formations 68 on the side wall 16. The recesses 66 and formations 68 also provide resistance to torsional forces.

The formation 56 on the support member **32*b* extends over the support surface 35 of the connecting member 36 and connects with a corresponding formation 56 on the support member 32*a*. The formation 56 is substantially continuous between the support members 32*a*, and 32*b***.

The support members **32*a*, 32*b*, 32*c* and 32*d*, together with connecting members 34 and 36, are movable between the first position in which they lie outside the body of the container 10 and the second position in which the detenting formations on the support members 32*a*, 32*b*, 32*c* and 32*d* engage the co-operating formations on the side walls 14**.

In the first position the containers 10 can be stacked one inside the other, so that a large number of containers can be stored in a small space.

When the container 10 is filled with mushrooms, for example, then support members **32*a*, 32*b*, 32*c* and 32*d* together with connecting members 34 and 36 can be pivotted to the second position and secured in that position. This enables the further container to be stacked on the container 10** without crushing the produce contained therein.

I claim:

1. A container comprising a body having a base, two pairs of opposed side walls extending upwardly from the base to define a corner between adjacent side walls, four support members, each support member being disposed at a respective corner, the support members being selectively movable between a first position in which a further container can be nested inside the body, and a second position in which the support members can support the further container above the base, wherein a first pair of said support members is connected together by a first connecting member provided therebetween, and a second pair of said support members is connected together by a second connecting member provided therebetween, and a strengthening formation is provided which extends substantially continuously over each support member and along the respective connecting member to which each support member is connected, each strengthening formation engaging the inner surface of said side walls when the support members are in the second position.

2. A container according to claim 1, wherein each connecting member is generally elongate with a longitudinal axis which is substantially parallel to an axis passing through the two support members to which the connecting member is connected.

3. A container according to claim 1, wherein the lateral dimension of each connecting member is less than the corresponding lateral dimension of each support member.

4. A container according to claim 1, wherein each connecting member is provided with a support surface which can support the further container when the support members are in the second position.

5. A container according to claim 1, wherein each connecting member is provided with a plurality of recesses along its length, and two opposed side walls of the body are provided with a plurality of co-operating formations, said first formations being received in said recesses when said support members are in the second position.

6. A container according to claim 1, wherein the side walls are provided with recesses for receiving part of the said strengthening formations on the support members when the support members are in the second position.

7. A container according to claim 1, wherein the support members and the side walls are provided with complementary detent means for securing the support members in the second position, said complementary detent means comprising at least one resilient tongue on each support member adapted to extend through a respective aperture on the side wall and engage a respective resilient tongue on the side wall.

8. A container according to claim 7, wherein when the support member is in the second position the or each resilient tongue on the support members lies between the respective resilient tongue on the side walls and the space within the container body.

9. A container according to claim 7, wherein the resilience of the tongues on the support members is such that they can be snapped out of engagement with the tongues on the side walls with the application of a predetermined amount of force.

10. A container according to claim 1, wherein each support member is of substantially triangular configuration.

11. A container according to claim 1, wherein a locating formation is provided which extends upwardly and is disposed continuously along an upper surface of each pair of support members and of the connecting member therebetween, said locating formation defining a boundary within which the further container may be positioned on top of the support member.

12. A container according to claim 11, wherein each locating formation also acts as a strengthening formation.

13. A container according to claim 1, wherein each connecting member is secured to one of the side walls between its respective pair of support members.

* * * * *